US011615683B2

(12) United States Patent
Gadonniex et al.

(10) Patent No.: US 11,615,683 B2
(45) Date of Patent: Mar. 28, 2023

(54) SURFACE MOUNT BACK SCATTER PHOTO-ELECTRIC SMOKE DETECTOR

(71) Applicant: Carrier Corporation, Palm Beach Gardens, FL (US)

(72) Inventors: Dennis M. Gadonniex, Bradenton, FL (US); Dariia Lysenko, Sarasota, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 71 days.

(21) Appl. No.: 17/249,947

(22) Filed: Mar. 19, 2021

(65) Prior Publication Data

US 2021/0312779 A1 Oct. 7, 2021

Related U.S. Application Data

(60) Provisional application No. 63/003,391, filed on Apr. 1, 2020.

(51) Int. Cl.
*G08B 17/107* (2006.01)

(52) U.S. Cl.
CPC ..... *G08B 17/107* (2013.01)

(58) Field of Classification Search
CPC ..... G08B 17/107
See application file for complete search history.

(56) References Cited

U.S. PATENT DOCUMENTS

| | | | | |
|---|---|---|---|---|
| 6,218,950 | B1 * | 4/2001 | Politze | G08B 17/107 340/630 |
| 7,969,296 | B1 * | 6/2011 | Stell | G08B 25/10 340/522 |
| 8,546,740 | B2 * | 10/2013 | Vollenweider | G08B 17/103 340/630 |
| 2011/0057805 | A1 * | 3/2011 | Loepfe | G08B 17/107 340/628 |
| 2015/0379846 | A1 * | 12/2015 | Bressanutti | G08B 17/113 340/630 |
| 2020/0312108 | A1 * | 10/2020 | Gadonniex | G08B 17/117 |
| 2021/0166542 | A1 * | 6/2021 | Patel | G08B 29/145 |
| 2021/0295666 | A1 * | 9/2021 | Gadonniex | G08B 17/107 |

FOREIGN PATENT DOCUMENTS

EP 3413279 A1 12/2018

* cited by examiner

*Primary Examiner* — Travis R Hunnings
(74) *Attorney, Agent, or Firm* — Souad Hakim

(57) ABSTRACT

A smoke detector with a surface mounted emitter configured to emit light substantially vertically and a surface mounted receiver configured to receive light at an angular distance less than 90° reflected by ambient materials, and a method of operating the smoke detector are provided. The angular distance at which the light is reflected by the ambient materials generates a back scatter effect. The smoke detector includes a housing defining a chamber for receiving the ambient materials, a supporting structure (e.g., a printed circuit board (PCB)) disposed adjacent to the housing, an emitter mounted substantially vertically to an upper surface of the supporting structure, and a receiver mounted substantially vertically to the upper surface of the supporting structure. The smoke detector may also include a controller configured to receive output signals from the receiver (to determine whether a current condition of the chamber indicates a need to trigger an alarm).

17 Claims, 7 Drawing Sheets

SURFACE MOUNT BACK SCATTER PHOTO-ELECTRIC SMOKE DETECTOR

CROSS REFERENCE TO A RELATED APPLICATION

The application claims the benefit of U.S. Provisional Application No. 63/003,391 filed Apr. 1, 2020, the contents of which are hereby incorporated in their entirety.

BACKGROUND

A smoke detector is a device that detects smoke and issues an alarm. A photo-electric smoke detector is a type of smoke detector that works based on light reflection principles.

Conventional photo-electric smoke detectors include an optic chamber configured to receive smoke particles, at least one light emitter configured to emit light into the chamber, and at least one light receiver configured to receive light reflected off of the smoke particles in the chamber. Commonly, the emitter and receiver are configured in a forward light scattering arrangement, meaning that the angle between the emitter and receiver is greater than 90°. These conventional smoke detectors are commonly manufactured with the emitter(s) and the receiver(s) being manually inserted through holes that are punctured in a printed circuit board (PCB). With these smoke detector relying on specific angles for reliable detection, it is vitally important that the emitter(s) and receiver(s) are accurately placed. As such, the reliance on manual insertion of the components may complicate the manufacturing process.

As mentioned above, photo-electric smoke detectors rely on the reflection of light off of smoke particles that are in the chamber. When there is no smoke in the optic chamber, and the optic chamber is empty or mostly empty, the light receiver typically receives a small amount of light reflected from the chamber surfaces. On the other hand, when smoke is present in the optic chamber, the light receiver receives more light due to the light being reflected from the smoke particles. When an amount of light received by the receiver exceeds a certain threshold, an alarm is triggered.

Conventional photo-electric smoke detectors are able to detect the mid-size particles that are produced during the "flaming foam fire" test and in real-world fires that typically generate mid-size particles and present hazards to life and property, such as wood fires and other flammable materials fires, but often produce false alarms with smoke-producing and particle-producing events deemed less hazardous such as cooking fires (particles too small) and steam (particles too large). Typically conventional photo-electric smoke detectors produce false alarms because they are not able to discriminate between large-size non-smoke particles, such as steam clouds, dust clouds, etc., and small-size non-smoke particles that are generated by certain types of cooking scenarios. That is, conventional photo-electric smoke detectors are not capable of determining when small-size non-smoke particles are generated by safe activities, such as broiling hamburgers, toasting bread, etc., and thus permit false alarms to be triggered. As a result, conventional photo-electric smoke detectors will not pass the requirements of Underwriter Laboratories (UL) 217-8 (residential) and 268-7 (commercial) standards. These standards require smoke detectors be configured to not sound an alarm until after a certain threshold during the "broiling hamburger" test, but before a certain threshold during the "flaming foam fire" test.

Accordingly, there remains a need for a smoke detector, and method of operating such smoke detector, that is capable of being more simply manufactured, and that has reduced complexity and lower costs (e.g., compared to existing smoke detectors that are capable of satisfying the requirements of UL 217-8 and 268-7), while satisfying the requirements of UL 217-8 and 268-7 standards.

BRIEF DESCRIPTION

According to one embodiment, a smoke detector including a housing, a supporting structure, an emitter, and a receiver is provided. The housing defining a chamber for receiving ambient materials. The supporting structure is disposed adjacent to the housing. The supporting structure includes an upper surface. The emitter is mounted substantially vertically to the upper surface of the supporting structure. The emitter is configured to emit light substantially vertically into the chamber. The receiver is mounted substantially vertically to the upper surface of the supporting structure. The receiver is configured to receive light at an angular distance less than 90° reflected by the ambient materials in the chamber. The receiver is configured to generate output signals. The angular distance generates a back scatter effect.

In accordance with additional or alternative embodiments, the smoke detector further includes a controller disposed on the supporting structure. The controller is configured to receive output signals from the receiver and determine whether a current condition of the chamber indicates a need to trigger an alarm.

In accordance with additional or alternative embodiments, the supporting structure is a printed circuit board (PCB).

In accordance with additional or alternative embodiments, the emitter is mounted approximately central to the upper surface of the supporting structure within the smoke detector.

In accordance with additional or alternative embodiments, the smoke detector further includes an optics cover disposed between the housing and the supporting structure. The optics cover includes an opening for the emitter and an opening for the receiver.

In accordance with additional or alternative embodiments, the opening for the receiver includes a shield for reducing an optical noise.

In accordance with additional or alternative embodiments, the housing includes at least one of: a labyrinth geometry and a ring, each respectively configured to reduce an optical noise.

In accordance with additional or alternative embodiments, the emitter has a cone of dispersion of less than 60 degrees.

In accordance with additional or alternative embodiments, the receiver has a viewing angle less than 60 degrees.

In accordance with additional or alternative embodiments, the smoke detector has only one emitter and only one receiver.

In accordance with additional or alternative embodiments, the controller determines whether the current condition is a fast fire, or a slow fire.

In accordance with additional or alternative embodiments, the smoke detector is configured to detect ambient materials.

In accordance with additional or alternative embodiments, the controller monitors a time increment between a first output signal threshold and a second output signal threshold to determine whether a current condition of the chamber indicates a need to trigger an alarm.

In accordance with additional or alternative embodiments, the first output signal threshold is 0.5 percent obscuration per foot (% obs/ft.) and the second output signal threshold is 1.25% obs/ft.

In accordance with additional or alternative embodiments, the controller triggers an alarm when an output signal of 1.5% obs/ft. is received when the time increment is less than sixty (60) seconds.

In accordance with additional or alternative embodiments, the controller triggers an alarm when an output signal of 2.0% obs/ft. is received when the time increment is greater than sixty (60) seconds.

In accordance with additional or alternative embodiments, the controller is configured to trigger an alarm prior to receiving an output signal of 5% obs/ft. when the time increment is less than sixty (60) seconds.

In accordance with additional or alternative embodiments, the controller is configured to avoid triggering an alarm prior to receiving an output signal of 1.5% obs/ft. when the time increment is greater than sixty (60) seconds.

According to another aspect of the invention, a method for operating a smoke detector including a controller with an alarm processing component, a housing defining a chamber, a supporting structure, an emitter mounted substantially vertically to the supporting structure and configured to emit light, and a receiver mounted substantially vertically to the supporting structure and configured to receive light is provided. The method may be performed in the alarm processing component. The method includes a step for receiving, from the receiver at the controller, output signals resulting from light emitted into the chamber by the emitter, the light being reflected toward the receiver at an angular distance less than 90° by ambient materials in the chamber, wherein the angular distance generates a back scatter effect. The method also includes a step for determining, in the alarm processing component of the controller, whether a current condition of the chamber indicates a fast fire or a slow fire based on a time increment between a first output signal threshold and a second output signal threshold.

In accordance with additional or alternative embodiments, the first output signal threshold is 0.5 percent obscuration per foot (% obs/ft.) and the second output signal threshold is 1.25% obs/ft.

In accordance with additional or alternative embodiments, the method further includes triggering an alarm when an output signal of 1.5% obs/ft. is received by the controller when the time increment is less than sixty (60) seconds.

In accordance with additional or alternative embodiments, the method further includes triggering an alarm when an output signal of 2.0% obs/ft. is received by the controller when the time increment is greater than sixty (60) seconds.

In accordance with additional or alternative embodiments, the controller is configured to trigger an alarm prior to receiving an output signal of 5% obs/ft. when the time increment is less than sixty (60) seconds.

In accordance with additional or alternative embodiments, the controller is configured to avoid triggering an alarm prior to receiving an output signal of 1.5% obs/ft. when the time increment is greater than sixty (60) seconds.

BRIEF DESCRIPTION OF THE DRAWINGS

The subject matter, which is regarded as the disclosure, is particularly pointed out and distinctly claimed in the claims at the conclusion of the specification. The following descriptions of the drawings should not be considered limiting in any way. With reference to the accompanying drawings, like elements are numbered alike:

DETAILED DESCRIPTION

Figure 1:
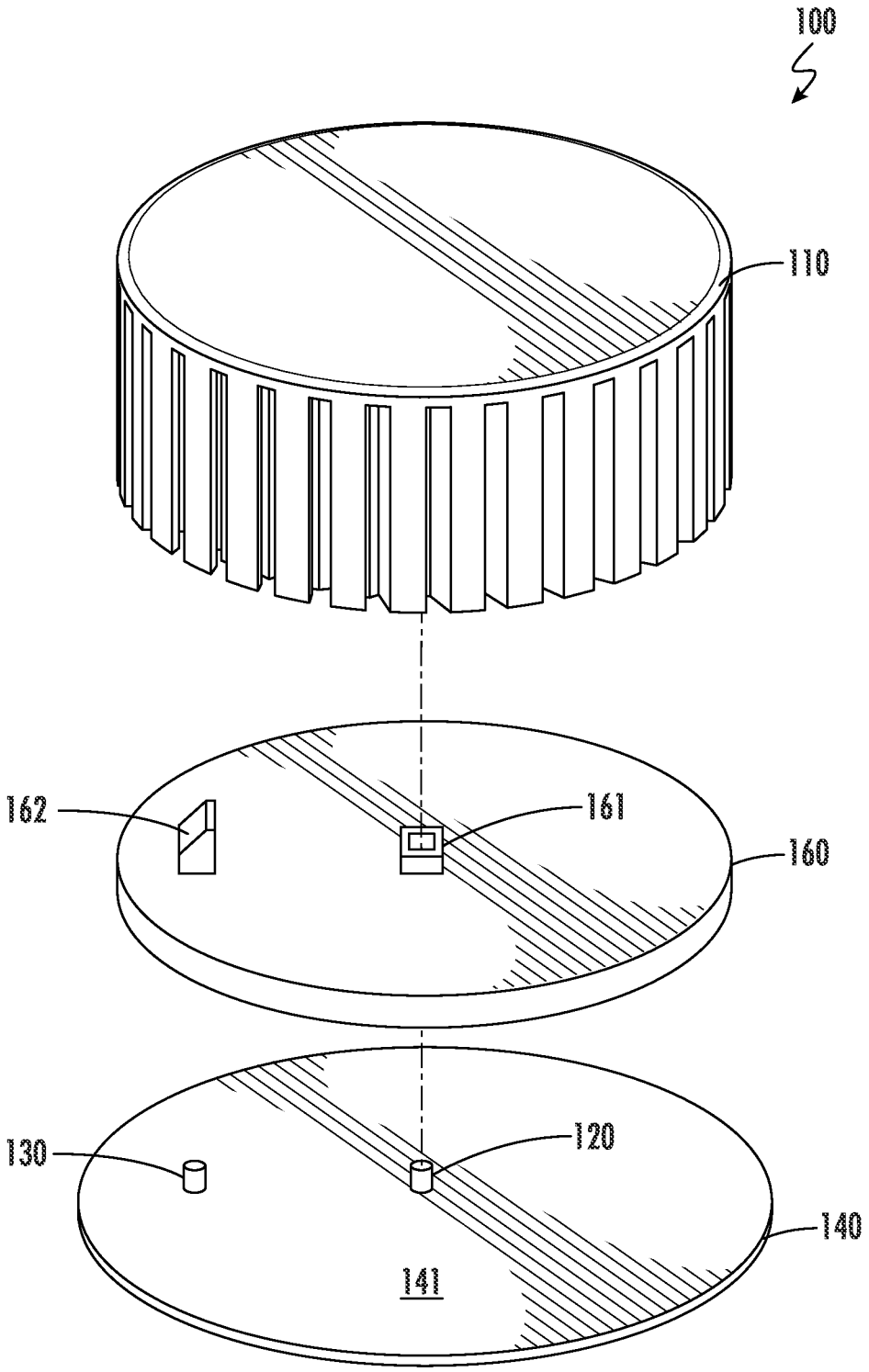
FIG. 1 is an exploded view of a smoke detector in accordance with one aspect of the disclosure.

Underwriter Laboratories (UL) 217-8 (residential) and 268-7 (commercial) standards require smoke detectors be configured to not sound an alarm until after a certain threshold (1.5% obs/ft.) during the "broiling hamburger" test (e.g., which may be viewed as a slow fire), but before a certain threshold (5% obs/ft.) during the "flaming foam fire" test (e.g., which may be viewed as a fast fire). To meet these requirements smoke detectors have been designed, which include multiple emitters configured to emit multiple kinds of light at various angles to one or more receivers, generating a combination of infrared forward scatter, infrared back scatter, and blue forward scatter. These detectors are sometimes referred to as "multi-wave, multi-angle smoke detectors". To reduce the cost and complexity of the smoke detector while maintaining the ability to discriminate between particles, a photo-electric smoke detector with a surface mounted emitter configured to emit light substantially vertically into a chamber and a surface mounted receiver configured to receive light at an angular distance less than 90° reflected by ambient materials in the chamber is provided. It should be appreciated that the smoke detector may, in certain instances, include only one emitter and only one receiver. The configuration of the emitter and the receiver in the smoke detector may enable the smoke detector to have more accurate readings (e.g., by being able to discriminate between particles), which may enable the smoke detector to trigger an alarm appropriately (e.g., avoiding false alarms).

The emitter and the receiver may be mounted to the upper surface of a supporting structure (e.g., a printed circuit board (PCB) or other substrate) using surface-mount technology. A supporting structure may be viewed as a component of a smoke detector that mechanically supports and communicatively connects components (e.g., the emitter, receiver, and/or controller) of the smoke detector (e.g., using conductive tracks, pads, or other features etched from one or more layers of copper onto and/or between one or more non-conductive sheets).

Surface-mount technology is a method of mounting electrical components directly onto a surface (e.g., an upper surface) of a supporting structure (e.g., a printed circuit board (PCB) or other substrate). This method may provide for a solder pad (e.g., made of tin-lead, or gold plated copper) to be placed at each respective location where a component is to be mounted on the supporting structure. Additionally, the method may provide for solder paste (e.g., made of flux and solder particles) to be applied to each respective solder pad (e.g., using screen printing process, or jet-printing mechanism) before the components are mounted on the respective solder pads. It should be appreciated that alternative methods of surface mounting the components (e.g., the emitter and the receiver) may be utilized. For example, the components (e.g., the emitter and the receiver) may be mounted to the supporting structure using a plug in connection that may or may not require solder pads and/or solder paste. To place each of the components, the method may incorporate a pick-and-place machine, which may remove the need for manual placement of the components. The ability to use the pick-and-place machine is enabled by the design of the smoke detector. For example, by designing the smoke detector to have surface mounted components (instead of requiring the insertion of components through holes) that work in a vertical fashion (instead of relying on precise horizontal angles between components) the pick-and-place machine is a viable option to use in the manufacturing process. Once the components are placed on the supporting structure the supporting structure may be placed in a heating device (e.g., a soldering oven) to bond the components to the supporting structure. To remove excess material (e.g., flux and solder) each supporting structure may be washed before the supporting structure is configured within the smoke detector.

An electrical component mounted to a surface of a supporting structure using surface mount technology may be referred to as a surface mounted device. The emitter and the receiver of the smoke detector described herein may be referred to as surface mounted devices. By mounting the emitter and the receiver to the upper surface of the supporting structure (e.g., using surface mount technology) instead of through punctured holes in the supporting structure, the smoke detector may have a simplified the manufacturing process (e.g., a process that does not require manual insertion of components, such as, the emitter and the receiver), and have increased consistency in the placement of components which require precise placement. This increase in consistency in component placement may be due to the configuration and use of a pick-and-place machine and orientation of the components in the smoke detector design.

Both the emitter and the receiver may be configured to be mounted substantially vertically to the upper surface of the supporting structure. Substantially vertically may mean that the component (e.g., the emitter and/or the receiver) is approximately perpendicular to the supporting structure (e.g., forming a 90° angle, +/−5°, between the side of the component and the upper surface of the supporting structure). This vertical placement and way in which the light is directed (e.g., in a substantially vertical manner, substantially perpendicular to the supporting structure) may have reduced susceptibility to component rotation when compared to horizontally mounted components (e.g., which direct light in a horizontal manner, parallel to the supporting structure, and rely on the components to be placed at precise horizontal angles). With the light being directed substantially vertically into the chamber by the emitter, if the emitter were to be rotated during placement the effectiveness of the smoke detector to detect smoke particles is less likely to be altered because the horizontal angle at which the emitter is placed is not critical.

Instead of producing a back scatter effect with the horizontal angle between the emitter and the receiver, the smoke detector described herein produces a back scatter effect by emitting light substantially vertically into the chamber. This light is reflected off of the ambient materials (e.g., which may include air and smoke and non-smoke particles carried by the air) at an angle toward the receiver. This angle at which the light is reflected off of the ambient materials may be referred to as an angular distance. This angular distance may be measured between the emitting axis extending from the emitter to the receiving axis extending from the receiver. This angular distance is configured to be less than 90°.

The angular distance at which the light is reflected by the ambient materials to the receiver generates a back scatter effect. This back scatter effect allows for heightened particle discrimination. By generating a back scatter effect, the smoke detector reduces the detection of smaller particles produced during the "broiling hamburger" test. This is because the small size particles produced during the "broiling hamburger" test generate a strong forward scatter signal and a weak back scatter signal. By reducing the detection of the smaller particles produced during the "broiling hamburger" test, more accurate readings of the larger particles produced during the "flaming foam fire" test and other real-world hazardous fires are possible. In certain instances, the smoke detector increases (i.e. amplifies) the amount of light emitted by the emitter to enable the detection of large particles. For example, the emission of light may be increased by increasing the power supplied to the emitter. In certain instances, the type of light emitted by the emitter is an infrared light or any light in the visible spectrum, such as blue light.

With reference now to the Figures, a smoke detector 100, in accordance with various aspects of the disclosure is shown in FIG. 1. The smoke detector 100 may, in certain instances, be referred to as a "detector". Although described herein to be used to detect smoke, the detector 100, may, in certain instances, be used to detect other constituents capable of entering the detector 100 (e.g., carbon monoxide, pollutants, other hazardous or nuisance materials). When used to detect smoke, the smoke detector 100 is capable of detecting when ambient materials, such as air and smoke and non-smoke particles carried by the air, enter the smoke detector 100. The smoke detector 100, in certain instances, is a photo-electric smoke detector.

Figure 2:
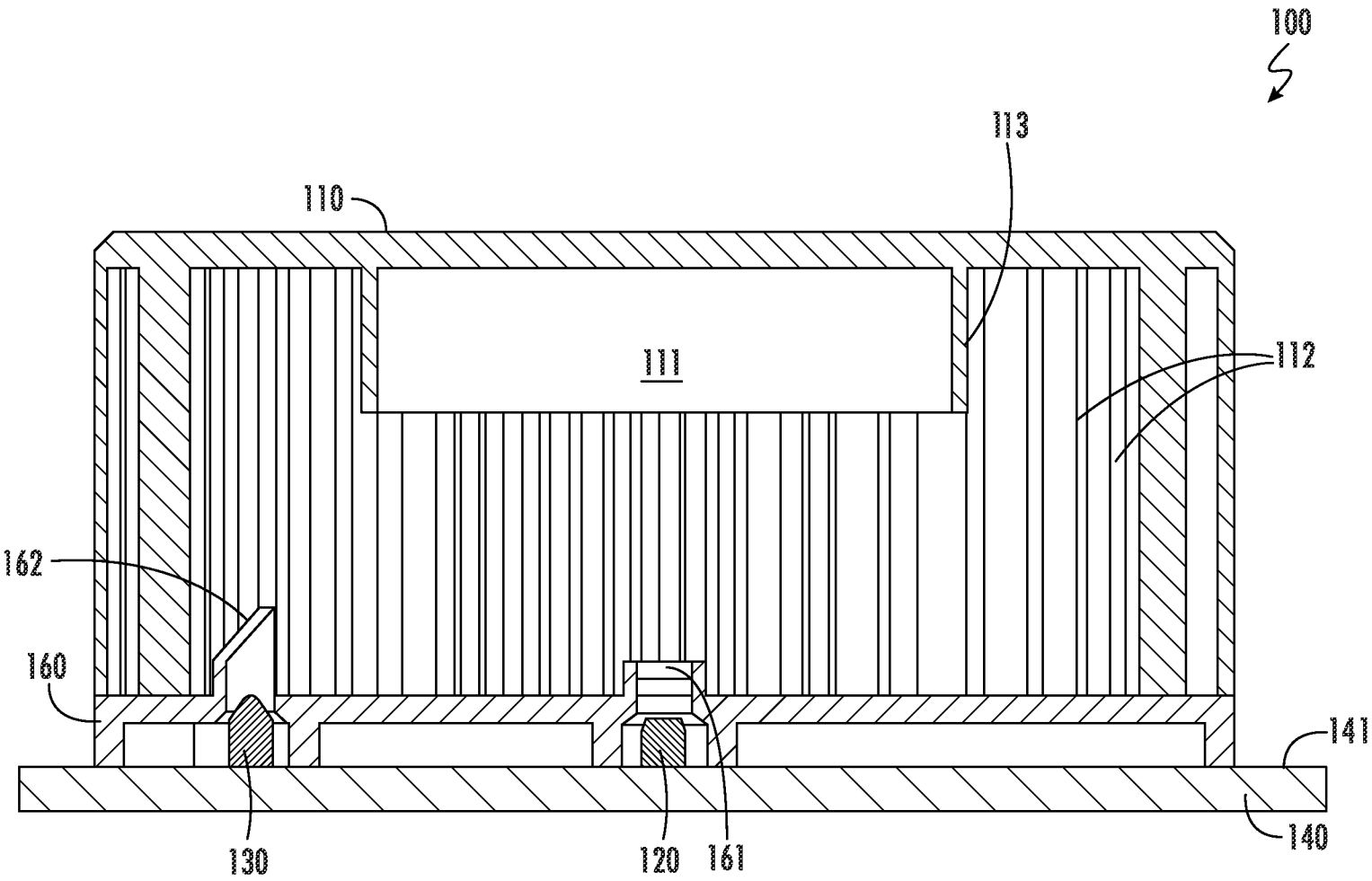
FIG. 2 is an assembled cross-sectional side view of the smoke detector shown in FIG. 1 in accordance with one aspect of the disclosure.

As shown in FIGS. 1 and 2, the smoke detector 100 includes a housing 110 defining a chamber 111 for receiving ambient materials, a supporting structure 140 disposed adjacent to the housing 110, an emitter 120 mounted substantially vertically to an upper surface 141 of the supporting structure 140, and a receiver 130 mounted substantially vertically to the upper surface 141 of the supporting structure 140. The emitter 120 may be any suitable light emitting diode (LED) capable of emitting light (e.g., infrared or any light in the visible spectrum, such as blue light) into the chamber 111. In certain instances, the smoke detector 100 includes only one emitter 120 and only one receiver 130. The emitter 120, in certain instances, is mounted approximately central to the upper surface of the supporting structure 140 within the smoke detector 100. Meaning that, when the smoke detector 100 is configured in a circle, the emitter 120 may be substantially equidistantly mounted within the perimeter of the supporting structure 140. Equidistantly mounted may mean that the emitter 120 is no closer to one side of the smoke detector 100 than another side of the smoke detector 100.

As shown in FIGS. 1 and 2, in certain instances, the smoke detector 100 may further include an optics cover 160 disposed between the housing 110 and the supporting structure 140. To facilitate the emitting and receiving of light, the optics cover 160 may include an opening 161 for the emitter 120, and an opening 162 for the receiver 130. The opening 162 for the receiver 130 may include a shield for reducing an optical noise. Optical noise may be interpreted to mean light being directed toward the receiver 130 from an outside source (e.g., not from the emitter 120) and/or light emitted by the emitter 120 that is reflected off of the housing 110 toward the receiver 130. In certain instances, the shield of the opening 162 for the receiver 130 is configured with an opening towards the emitter 120 and a barrier towards the housing 110 to reduce optical noise.

Figure 3:
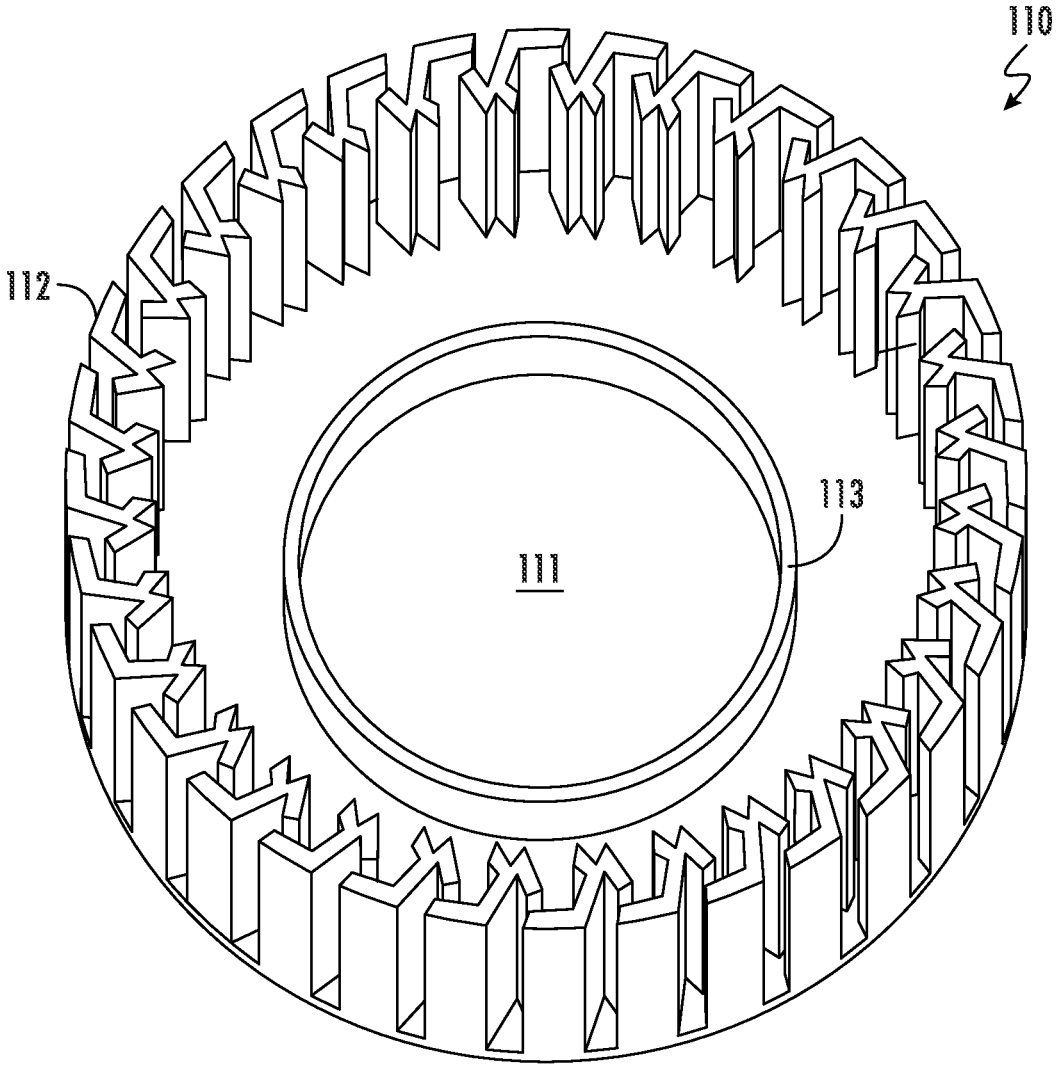
FIG. 3 is a perspective view of a housing for a smoke detector in accordance with one aspect of the disclosure.

To further reduce optical noise the housing 110 may be configured to include at least one of: a labyrinth geometry 112 and a ring 113. A housing 110 with a labyrinth geometry 112 and a ring 113 is shown in FIGS. 2 and 3. The ring 113 may reduce optical noise by helping reduce light that is emitted by the emitter 120 from being reflected within the housing 110 (e.g., by blocking light reflected off of the housing 110). To block the light that is reflected off of the housing 110, the ring 113 may extend toward the supporting structure 140 in a circumferential manner, as shown in FIGS. 2 and 3. The labyrinth geometry 112 may reduce optical noise by preventing light produced outside of the smoke detector 100 from coming into the smoke detector 100. For example, the labyrinth geometry 112 may be configured in an overlapping manner (as shown in FIG. 3) to prevent light from coming in from outside the smoke detector 100. In addition to reducing the optical noise, this labyrinth geometry 112 may prevent large particles, debris, and bugs (which may interfere with the proper function of the smoke detector 100) from entering the chamber 111. It should be appreciated that the chamber 111 may be viewed as the internal space within the housing 110 (e.g., bounded inside the labyrinth geometry 112 of the housing 110, above the optics cover 160), which may include both inside and outside the ring 113 (if incorporated).

Figure 4:
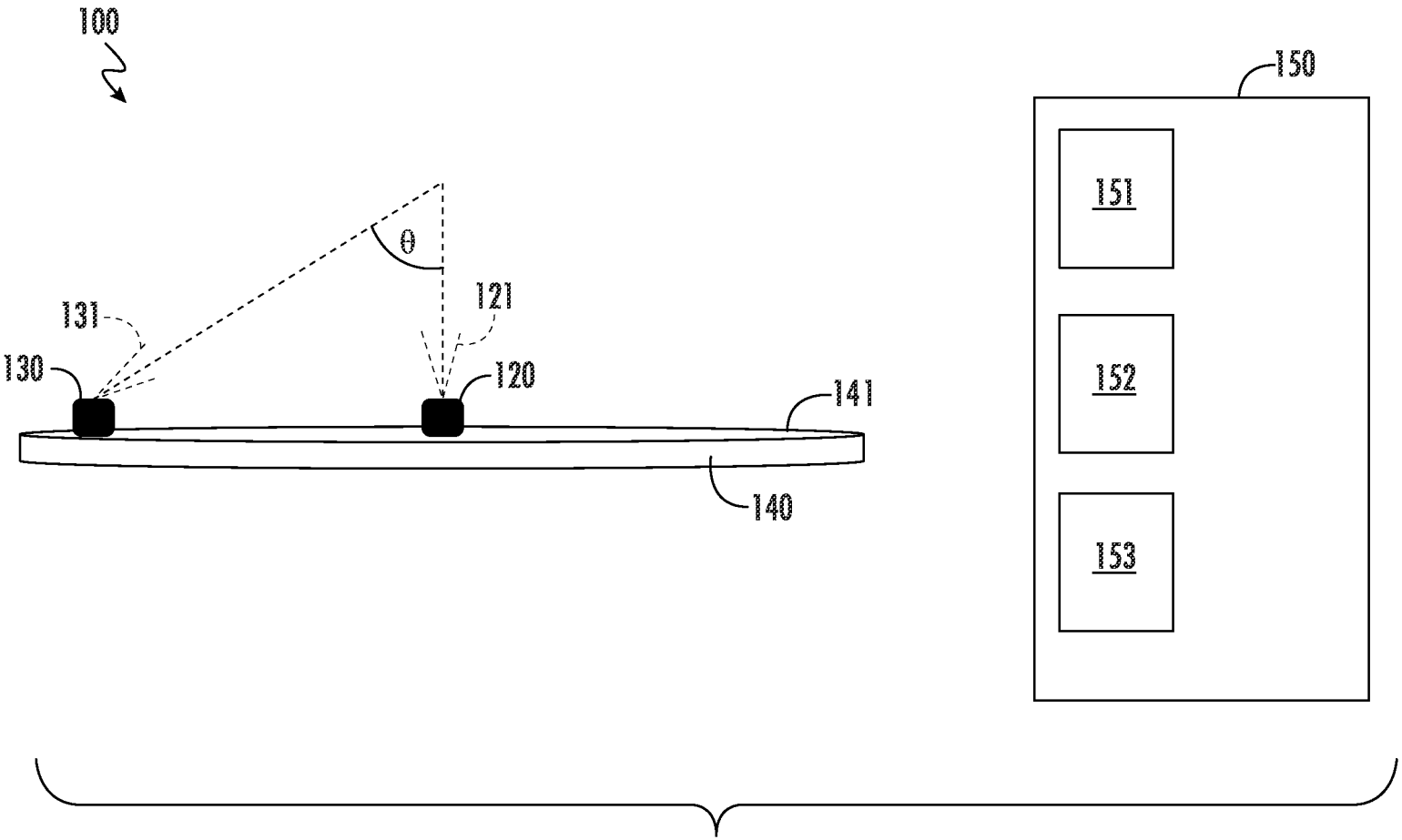
FIG. 4 is a schematic illustration of an emitter and a receiver mounted to an upper surface of a supporting structure (e.g., a printed circuit board (PCB)), and a controller in accordance with one aspect of the disclosure.

As shown in FIG. 4, the smoke detector 100 includes an emitter 120 and a receiver 130, each being mounted substantially vertically to the upper surface 141 of the supporting structure 140. The emitter 120 is configured to emit light substantially vertically through the chamber 111 (e.g., substantially perpendicular from the supporting structure 140 through the chamber 111). The emitter 120 may be configured to emit the light within a cone of dispersion 121, which may be less than sixty (60) degrees. The cone of dispersion may be interpreted to mean the path of emitted light. The cone of dispersion may be measured from the vertical axis of the emitter 120 (e.g., measured from either side of the vertical axis). The receiver 130 is configured to receive light at an angular distance θ less than 90° reflected by ambient materials in the chamber 111. The receiver 130 may be configured to receive the light through a viewing angle 131, which may be less than sixty (60) degrees. The viewing angle may be interpreted to mean the path at which the receiver 130 can receive light. The viewing angle may be measured along either side of the receiving axis.

The receiver 130 is configured to receive light reflected from the ambient materials in the chamber 111 and generate output signals. The output signals are sent from the receiver 130 to the controller 150. Instead of indicating a difference in wavelength (as is done in multi-wave multi-angle smoke detectors), the output signals indicate an intensity of light the receiver 130 receives, for example, a particular voltage received, which may in turn be used by the controller 150 to calculate a % obs/ft. in the chamber 111, as explained further below. The controller 150 uses these output signals to determine whether a current condition of the chamber 111 indicates a need to trigger an alarm.

The controller 150 may be disposed on the supporting structure 140 and/or disposed on a separate supporting structure (not shown). Disposed on the supporting structure 140 may mean that the controller 150 may be integrated within the supporting structure 140 (e.g., as a component of the supporting structure 140). If disposed on a separate supporting structure (not shown), the separate supporting structure (not shown) may be communicatively connected to the supporting structure 140. For example, if the supporting structure 140 is a printed circuit board (PCB), the controller 150 may be on a separate PCB, which may be communicatively connected (e.g., through one or more wired or wireless connections) to the main PCB 140.

It should be appreciated that the output signal sent to the controller 150 by the receiver 130 may be converted by the controller 150 (e.g., in an alarm processing component 152) from an analogue signal to a digital signal. For example, a received analogue signal (e.g., which may indicate a particular voltage of light received by the receiver 130) may be broken by an alarm processing component 152 in the controller 150 into equal segments (e.g., distributed among 256 digital units). The units may be known as "counts". A given % obs/ft. may be equivalent to a set number of counts. For example, for 0.5% obs/ft., a minimum number of signal counts are expected. The establishing of the equivalent counts for a given % obs/ft. may be established during a calibration procedure (e.g., at the time of manufacture). For example, the emitter 120, receiver 130, and/or controller 150 may be adjusted until the output signal(s) sent by the receiver 130 to the controller 150 correctly correspond to the obscuration reading(s) measured by an external calibrated device. In certain instances, the external calibrated device may be an ionic smoke detector or a calibrated smoke box lamp. It is envisioned that calibration of the smoke detector 100 may be completed using any suitable device that is capable of ensuring the output signal(s) correctly reflect the obscuration reading(s) by an external calibrated device.

The controller 150, as shown in FIG. 4, may include a receiver controlling component 151 operatively coupled with the receiver 130 for controlling the operation of the receiver 130, an alarm processing component 152 (e.g., a microprocessor) communicatively coupled with the receiver 130 to receive output signals from receiver 130 and complete the determination of whether or not to trigger an alarm, and an emitter controlling component 153 operatively coupled with the emitter 120 for controlling the operation of the emitter 120. Although described herein to include a receiver controlling component 151, and an emitter controlling component 153, in certain instances, one or more components may or may not be combined and/or not included. The controller 150, in certain instances, through the emitter controlling component 153, may increase (i.e. amplify) the amount of light emitted by the emitter 120 to enable the detection of large particles by the smoke detector 100.

Figure 6:
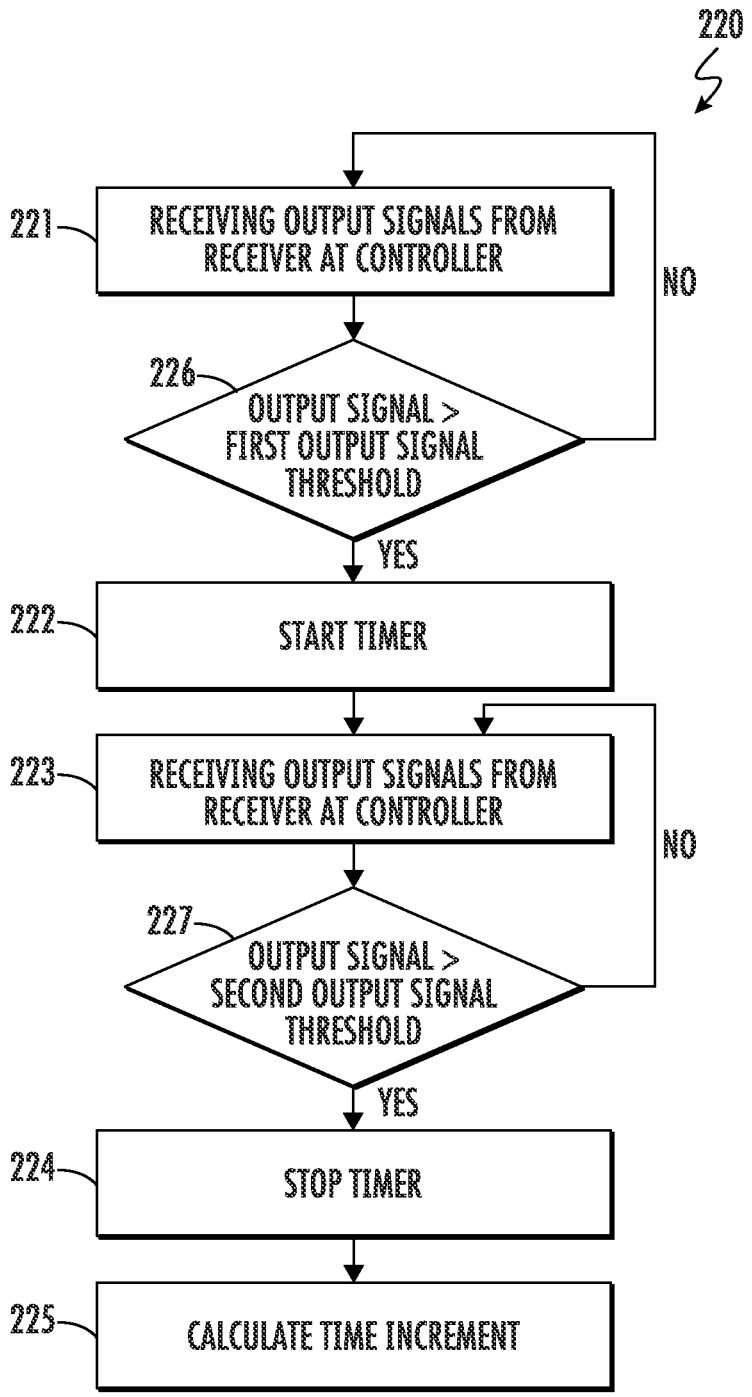
FIG. 6 is a flow diagram illustrating a calculation of a time increment in accordance with one aspect of the disclosure.

The controller 150, through the alarm processing component 152, may calculate a time increment. This time increment may be used by the controller 150 to determine whether the current condition of the chamber 111 indicates the presence of a fast fire or a slow fire. This time increment may be calculated by the controller 150 by monitoring the amount of time that elapses between receiving an output signal (e.g., indicating a particular % obs/ft. in the chamber 111) that is greater than a first output signal threshold (e.g., % obs/ft.) and receiving an output signal (e.g., indicating a particular % obs/ft. in the chamber 111) that is greater than a second output signal threshold (e.g., % obs/ft.), as shown in FIG. 6. In certain instances, the first output signal threshold is about 0.5 percent obscuration per foot (% obs/ft.) and the second output signal threshold is about 1.25% obs/ft. It should be appreciated that the first output signal threshold and the second output signal threshold may be any value(s) capable of indicating (e.g., to a person of ordinary skill in the art) the difference between a fast fire and a slow fire.

The controller 150, in certain instances, triggers an alarm at different thresholds depending on the time increment between the first output signal threshold and the second output signal threshold. When the time increment is less than sixty (60) seconds, in certain instances, the controller 150 triggers an alarm when an output signal indicating 1.5% obs/ft. in the chamber 111 is received. A time increment of less than sixty (60) seconds may suggest that the current condition is a fast fire. When the time increment is greater than sixty (60) seconds, in certain instances, the controller 150 triggers an alarm when an output signal indicating 2.0% obs/ft. in the chamber 111 is received. A time increment of greater than sixty (60) seconds may suggest that the current condition is a slow fire.

Figure 5:
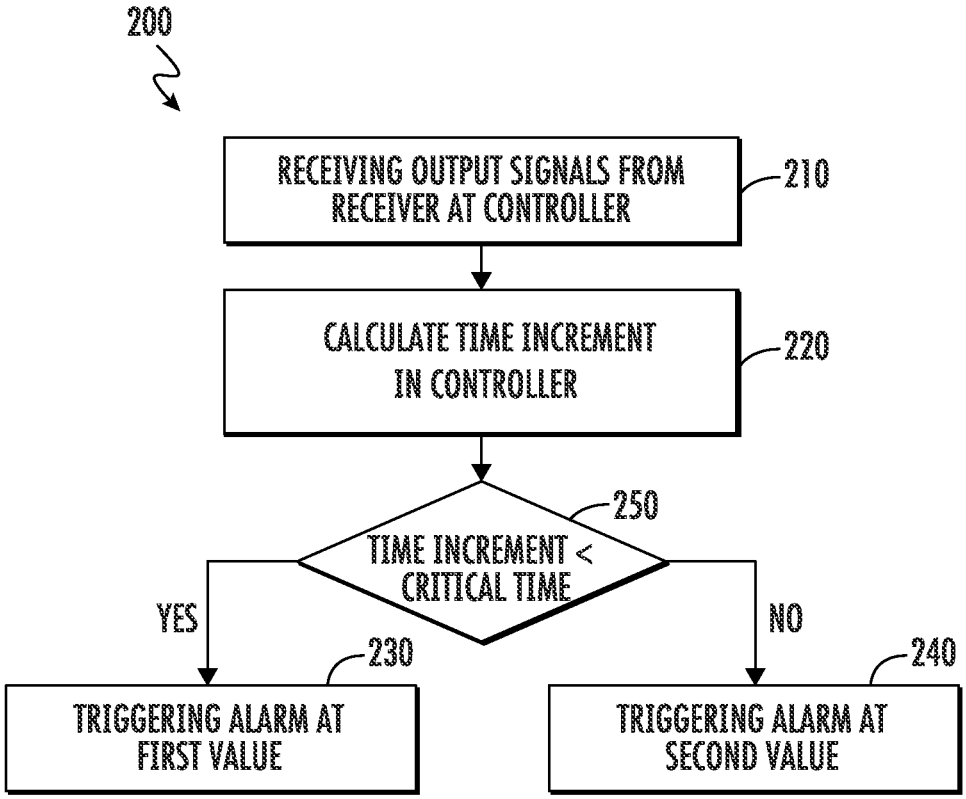
FIG. 5 is a flow diagram illustrating a method for operating a smoke detector in accordance with one aspect of the disclosure.

The configuration/operation of the components in the smoke detector 100 described above make it possible to discriminate between particles and distinguish fast fires from slow fires (e.g., avoiding false alarms). An exemplary method 200 of operating smoke detector 100 is illustrated in FIG. 5. The method 200 may be performed, for example, using the exemplary smoke detector 100 shown in FIGS. 1-4, which includes a housing 110 defining a chamber 111, a supporting structure 140, an emitter 120 mounted substantially vertically to the supporting structure 140 and configured to emit light, and a receiver 130 mounted substantially vertically to the supporting structure 140 and configured to receive light, and a controller 150, which may be configured to both receive output signals from the receiver 130 and control the operation of the emitter 120 (e.g., through the emitter controlling component 153). The smoke detector 100, in certain instances, includes only one emitter 120 and only one receiver 130.

Figure 7:
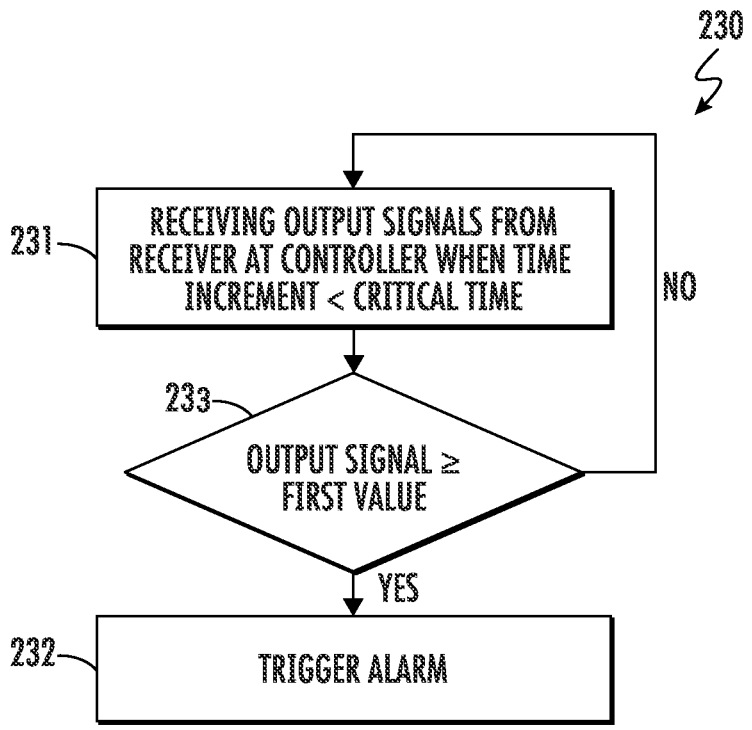
FIG. 7 is a flow diagram illustrating the triggering of an alarm for a fast fire in accordance with one aspect of the disclosure.
Figure 8:
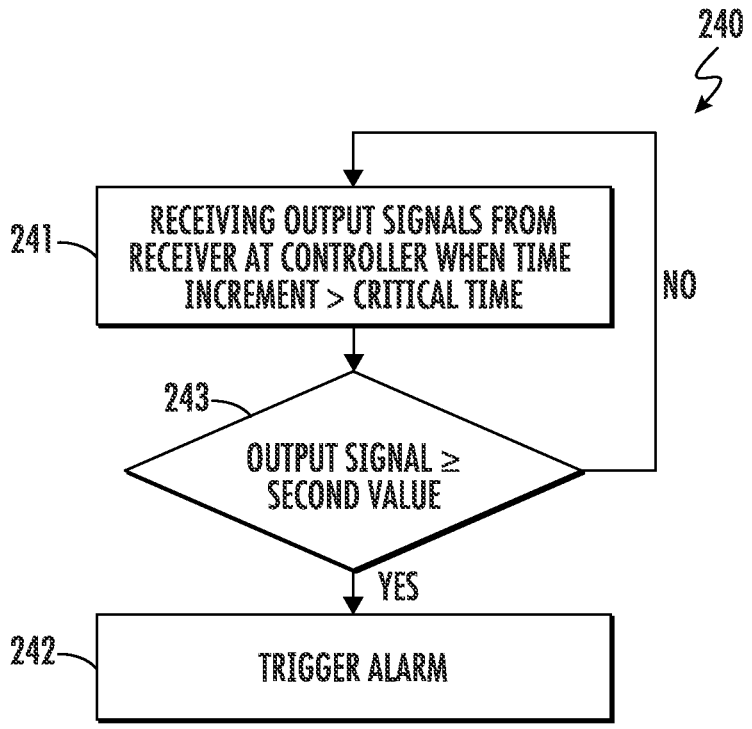
FIG. 8 is a flow diagram illustrating the triggering of an alarm for a slow fire in accordance with one aspect of the disclosure.

For purposes of clarity, the method 200, as shown in FIG. 5, has been broken down into multiple independent figures (FIGS. 6-8). FIG. 6 is provided to illustrate the calculation of a time increment (step 220 of FIG. 5). FIG. 7 is provided to illustrate the triggering of an alarm for a fast fire 230 (step 230 of FIG. 5). FIG. 8 is provided illustrate the triggering of an alarm for a slow fire 240 (step 240 of FIG. 5).

As shown in FIG. 5, the method 200 includes step 210 of receiving, from the receiver 130 at a controller 150, output signals (indicating a % obs/ft. in the chamber 111) resulting from light emitted into the chamber 111 by the emitter 120, the light being reflected toward the receiver 130 at an angular distance less than 90° by ambient materials in the chamber 111. Instead of calculating different output signal ratios, as is done by existing multi-wave, multi-angle smoke detectors, the method 200 calculates, in step 220, in the controller 150, a time increment to determine whether a current condition of the chamber 111 indicates a fast fire or a slow fire. This time increment is based on the amount of time between the controller 150 receiving an output signal (e.g., indicating a particular % obs/ft. in the chamber 111) greater than a first output signal threshold (e.g., % obs/ft.) and the controller 150 receiving an output signal (e.g., indicating a particular % obs/ft. in the chamber 111) greater than a second output signal threshold (e.g., % obs/ft.). In certain instances, the first output signal threshold is 0.5% obs/ft. and the second output signal threshold is 1.25% obs/ft. It should be appreciated that if no smoke is in the chamber 111 (e.g., when there is not a fire) the output signals (indicating a % obs/ft. in the chamber 111) received by the controller 150 will not be greater than the first output signal threshold, and as such the controller 150 will not start the timer or trigger an alarm.

The method 200 provides for step 250 of triggering an alarm at different values (% obs/ft.) dependent on the whether the current condition is a fast fire or a slow fire. As shown in FIG. 5, if the time increment is less than a critical time (i.e. the current condition is a fast fire) then the alarm is triggered at a first value (e.g., % obs/ft.). If the time increment is greater than a critical time (i.e. the current condition is a slow fire) then the alarm is triggered at a second value (e.g., % obs/ft.).

The calculation of this time increment 220, as part of the determining step 220, in accordance with one aspect of the disclosure, is shown in FIG. 6. The calculation of the time increment includes steps 221, 223 for receiving output signals from the receiver 130 at the controller 150. The method 200 provides for step 226 of comparing the received output signal to a first output signal threshold. If the output signal received from the receiver 130 by the controller 150 is greater than the first output signal threshold then a timer is started 222 in the controller 150. If the output signal received by the controller 150 is less than the first output signal threshold then the timer is not started.

In certain instances, the controller 150 continuously receives output signals from the receiver 130 to ensure timely starting/stopping of the timer. Continuously receiving may, in certain instances, be achieved by receiving an output signal from the receiver 130 at the controller 150 within every second. Continuously receiving may, in certain instances, be achieved by constantly sending output signals from the receiver 130 to the controller 150. In certain instances, the controller 150 non-continuously receives output signals from the receiver 130. For example, the controller 150 may periodically (e.g., one output signal every ten (10) seconds) receive output signals from the receiver 130. It should be appreciated that frequency at which the controller 150 receives output signals from the receiver 130 may change dependent, at least in part, on the presence of ambient materials in the chamber 111. For example, output signals may be sent from the receiver 130 to the controller 150 more frequently when ambient materials are detected in the chamber 111.

As shown in FIG. 6, once the timer is started 222 in the controller 150, the timer is stopped 224 once an output signal greater than a second output signal threshold is received from the receiver 130 at the controller 150. The method 200 provides for step 227 of comparing the received output signal to a second output signal threshold. If the output signal received from the receiver 130 by the controller 150 is greater than the second output signal threshold then the timer is stopped 224. If the output signal received by the controller 150 is less than the second output signal threshold then the timer is not stopped. Once the timer is stopped, the controller 150 calculates the time increment 225, which is the amount of time that elapses between the starting of the timer 222 and the stopping of the timer 224.

As mentioned above, the controller 150, in certain instances, uses this time increment to determine whether the current condition is a fast fire or a slow fire. If the time increment indicates that the current condition is a fast fire, the controller 150 triggers an alarm when the controller 150 receives an output signal (e.g., indicating a % obs/ft. in the chamber 111) from the receiver 130 that is greater than or equal to a first value (e.g., % obs/ft.). If the time increment indicates that the current condition is a slow fire, the controller 150 triggers an alarm when the controller 150 receives an output signal (e.g., indicating a % obs/ft. in the chamber 111) from the receiver 130 that is greater than or equal to a second value (e.g., % obs/ft.). The output signal at which the controller 150 triggers an alarm for a fast fire, in certain instances, is different from the output signal at which the controller 150 triggers an alarm for a slow fire. It should be appreciated that if the controller 150 does not receive an output signal from the receiver 130 that is greater than the respective value (e.g., greater than the first value for a first fire, or greater than the second value for a slow fire) then the controller 150 does not trigger an alarm. By differentiating between fast fire and slow fires the controller 150 may avoid false alarms (e.g., not sound an alarm until after a certain threshold (1.5% obs/ft.) during the "broiling hamburger" test, but before a certain threshold (5% obs/ft.) during the "flaming foam fire" test).

The triggering of an alarm for a fast fire 230 is shown in FIG. 7. A critical time less than sixty (60) seconds, in certain instances, indicates that the current condition is a fast fire. Once determined to be a fast fire by the controller 150, the controller 150 triggers an alarm when an output signal (e.g., indicating a % obs/ft. in the chamber 111) of greater than or equal to a first value (e.g., 1.5% obs/ft.) is received by the controller 150 from the receiver 130. To trigger the alarm appropriately step 233 of comparing the received output signal to the first value is provided.

The triggering of an alarm for a slow fire 240 is shown in FIG. 8. A critical time greater than sixty (60) seconds, in certain instances, indicates that the current condition is a slow fire. Once determined to be a slow fire by the controller 150, the controller 150 triggers an alarm when an output signal (e.g., indicating a % obs/ft. in the chamber 111) of greater than or equal to a second value (e.g., 2.0% obs/ft.) is received by the controller 150 from the receiver 130. To trigger the alarm appropriately step 243 of comparing the received output signal to the second value is provided.

The critical time may, in certain instances, be approximately sixty (60) seconds. However, it should be appreciated that the critical time may be any time capable of indicating (e.g., to a person of ordinary skill in the art) the difference between a fast fire and a slow fire.

The method 200 for operating the smoke detector 100 and configuration of the smoke detector 100 make it possible to discriminate between particles and differentiate between fast fires and slow fires, to avoid triggering false alarms at a lower cost point and with reduced complexity when compared to existing smoke detectors that are capable of discriminating between particles. Instead of requiring multiple emitters configured to emit multiple kinds of light at various angles to one or more receivers, the smoke detector 100 described herein is capable of using a single emitter 120 and a single receiver 130. As mentioned above, the smoke detector 100, by surface mounting the emitter 120 and the receiver 130 in a substantially vertically fashion, can be made with a more simplistically (e.g., as the smoke detector 100 does not rely on precise horizontal angles between components). Additionally, the substantially vertical mounting of the emitter 120 and the receiver 130 enables the smoke detector 100 to generate a back scatter effect, in a vertical fashion, by emitting light substantially vertically into the chamber and reflecting the light at an angle less than 90° off of the ambient materials in the chamber 111 toward the receiver 130. The generation of the back scatter effect enables the smoke detector 100 to obtain accurate readings (e.g., avoiding false alarms) to achieve particle discrimination.

The use of the terms "a" and "and" and "the" and similar referents, in the context of describing the invention, are to be construed to cover both the singular and the plural, unless otherwise indicated herein or cleared contradicted by context. The use of any and all example, or exemplary language (e.g., "such as", "e.g.", "for example", etc.) provided herein is intended merely to better illuminate the invention and does not pose a limitation on the scope of the invention unless otherwise claimed. No language in the specification should be construed as indicating any non-claimed elements as essential to the practice of the invention.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A smoke detector, comprising:

a housing defining a chamber for receiving ambient materials;

a supporting structure disposed adjacent to the housing, the supporting structure comprising an upper surface;

an emitter mounted substantially vertically to the upper surface of the supporting structure, the emitter configured to emit light substantially vertically into the chamber;

a receiver mounted substantially vertically to the upper surface of the supporting structure, the receiver configured to receive light at an angular distance less than 90° reflected by the ambient materials in the chamber, the receiver configured to generate output signals, wherein the angular distance generates a back scatter effect; and a controller disposed on the supporting structure, the controller configured to receive output signals from the receiver and determine whether a current condition of the chamber indicates a need to trigger an alarm, wherein the controller monitors a time increment between a first output signal threshold and a second output signal threshold to determine whether a current condition of the chamber indicates a need to trigger an alarm, and wherein the first output signal threshold is greater or equal to 0.5 percent obscuration per foot (% obs/ft.) and the second output signal threshold is greater or equal to 1.25% obs/ft.

2. The smoke detector of claim 1, wherein the emitter is mounted approximately central to the upper surface of the supporting structure within the smoke detector.

3. The smoke detector of claim 1, further comprising an optics cover disposed between the housing and the supporting structure, the optics cover comprising an opening for the emitter and an opening for the receiver.

4. The smoke detector of claim 3, wherein the opening for the receiver comprises a shield for reducing an optical noise.

5. The smoke detector of claim 1, wherein the housing comprises at least one of: a labyrinth geometry and a ring, each respectively configured to reduce an optical noise.

6. The smoke detector of claim 1, wherein at least one of: a cone of dispersion of the emitter and a viewing angle of the receiver are less than 60 degrees.

7. The smoke detector of claim 1, wherein the smoke detector comprises only one emitter and only one receiver.

8. The smoke detector of claim 1, wherein the controller triggers an alarm when an output signal of 1.5% obs/ft. is received when the time increment is less than sixty (60) seconds.

9. The smoke detector of claim 1, wherein the controller triggers an alarm when an output signal of 2.0% obs/ft. is received when the time increment is greater than sixty (60) seconds.

10. The smoke detector of claim 1, wherein the controller is configured to trigger an alarm prior to receiving an output signal of 5% obs/ft. when the time increment is less than sixty (60) seconds.

11. The smoke detector of claim 1, wherein the controller is configured to avoid triggering an alarm prior to receiving an output signal of 1.5% obs/ft. when the time increment is greater than sixty (60) seconds.

12. A method for operating a smoke detector comprising a controller comprising an alarm processing component, a housing defining a chamber, a supporting structure, an emitter mounted substantially vertically to the supporting structure and configured to emit light, and a receiver mounted substantially vertically to the supporting structure and configured to receive light, the method performed in the alarm processing component, the method comprising:

receiving, from the receiver at the controller, output signals resulting from light emitted into the chamber by the emitter, the light being reflected toward the receiver at an angular distance less than 90° by ambient materials in the chamber, wherein the angular distance generates a back scatter effect; and determining, in the alarm processing component of the controller, whether a current condition of the chamber indicates a need to trigger an alarm, wherein the first output signal threshold is greater or equal to 0.5 percent obscuration per foot (% obs/ft.) and the second output signal threshold is greater or equal to 1.25% obs/ft.

13. The method of claim 12, wherein a current condition of the chamber indicates a fast fire or a slow fire based on a time increment between a first output signal threshold and a second output signal threshold.

14. The method of claim 12, wherein the method further comprises triggering an alarm when an output signal of 1.5% obs/ft. is received by the controller when the time increment is less than sixty (60) seconds.

15. The method of claim 12, wherein the method further comprises triggering an alarm when an output signal of 2.0% obs/ft. is received by the controller when the time increment is greater than sixty (60) seconds.

16. The method of claim 12, wherein the controller is configured to trigger an alarm prior to receiving an output signal of 5% obs/ft. when the time increment is less than sixty (60) seconds.

17. The method of claim 12, wherein the controller is configured to avoid triggering an alarm prior to receiving an output signal of 1.5% obs/ft. when the time increment is greater than sixty (60) seconds.

* * * * *